United States Patent [19]

Viner

[11] 4,114,663

[45] Sep. 19, 1978

[54] AUTOMATIC SCREWDRIVER

[76] Inventor: Brynley Emberley Viner, 1 Wallace Rd., Broadstone, Dorset, England

[21] Appl. No.: 749,673

[22] Filed: Dec. 13, 1976

[51] Int. Cl.[2] ..... B25B 23/00

[52] U.S. Cl. ..... 144/32 R; 81/125; 221/263; 221/278; 227/116; 145/52

[58] Field of Search ..... 145/52; 81/125, 57.23, 81/57.37; 221/160, 263, 278; 144/32; 227/116

[56] References Cited

U.S. PATENT DOCUMENTS

| | | | |
|---|---|---|---|
| 2,684,698 | 7/1954 | Shaff | 144/32 |
| 2,840,126 | 6/1958 | Schmitt | 145/52 X |
| 2,845,968 | 8/1958 | Luber | 145/52 X |
| 2,985,208 | 5/1961 | Hibbard et al. | 81/125 X |
| 3,247,874 | 4/1966 | MacDonald | 144/32 |
| 3,298,410 | 1/1967 | Morifuji | 145/52 |
| 3,565,315 | 2/1971 | Bixler | 227/116 |
| 3,875,982 | 4/1975 | Mizu et al. | 144/32 |
| 3,895,431 | 7/1975 | Froehlking | 221/278 X |
| 3,958,614 | 5/1976 | Bandera | 144/32 R |
| 3,979,978 | 9/1976 | Smolik | 144/326 R X |
| 3,982,679 | 9/1976 | White, Jr. | 227/116 |

*Primary Examiner*—Gil Weidenfeld
*Assistant Examiner*—W. D. Bray
*Attorney, Agent, or Firm*—William Anthony Drucker

[57] ABSTRACT

An automatic screwdriving and feeding apparatus has a screwdriver body with a tubular housing axially moveable thereon. Screw holding elements are mounted in the tubular housing and are resiliently biased inwardly, or are resiliently deformable, so as to hold a screw for driving. Drive means in the body can move axially relatively to engage the screw and apply rotary drive. Feed means supply screws one at a time to the screw holding elements.

6 Claims, 9 Drawing Figures

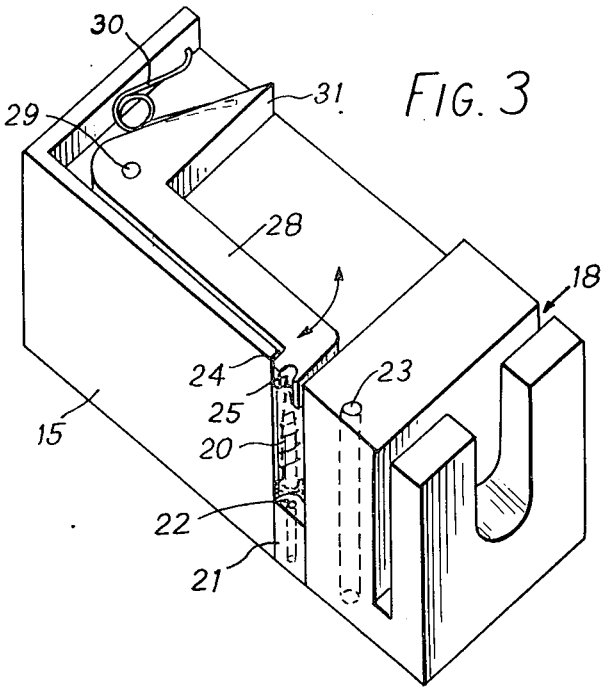
FIG. 3
FIG. 4
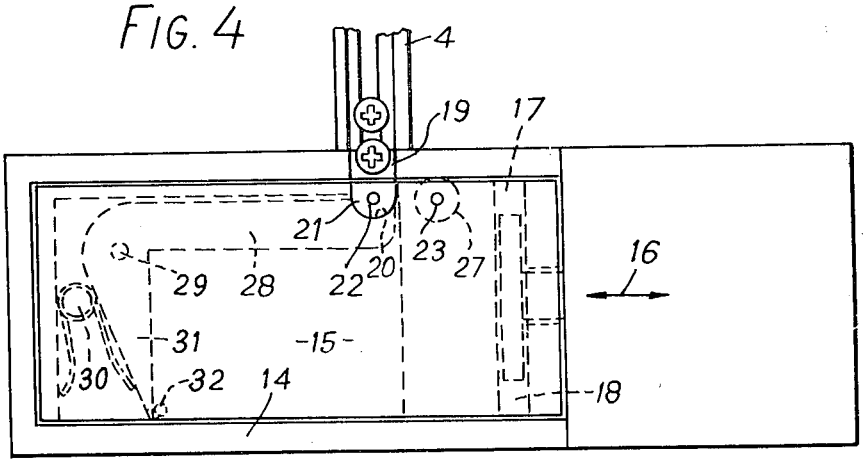

AUTOMATIC SCREWDRIVER

The invention relates to an automatic screwdriving and feeding apparatus. Pneumatically or electrically driven screwdrivers have been previously proposed for driving screws, particularly on assembly production lines, but have had the disadvantage that they have required the use of both hands of an operator, that is to say one hand to hold the screwdriver and the other hand to load a screw to be driven into holding means of the screwdriver, the screwdriver subsequently being advanced towards a workpiece with drive means of the screwdriver engaging a drive recess of the screw and rotating the screw to drive it into the workpiece. Automatically loaded screwdrivers have also been proposed but have not proved satisfactory mainly due to wastage of screws fed to a drive head of the screwdriver falling out of the head before they could be screwed into the workpiece.

According to the present invention, an automatic screwdriving and feeding apparatus comprises a screwdriver body including a tubular housing axially movable with respect to the remainder of the body, a plurality of screw holding elements mounted in or on said tubular housing, said screw holding elements being resiliently biased radially inwardly or being resiliently deformable such that they may hold a screw in axially disengageable manner, drive means in the screwdriver body adapted upon axial inwards movement of the tubular housing to engage with the screw and apply rotary drive thereto, and feed means to supply screws one at a time to the screw holding elements.

The screw holding elements, preferably balls, may be engaged in apertures in the wall of the housing and are resiliently biassed towards the centre of the housing by a surrounding flexible sleeve.

Alternatively the screw holding elements may comprise movable jaws provided at the end of the housing and resiliently biassed towards one another.

Preferably the feed means supplies screws one at a time through a feed tube which merges with the housing at an acute angle rearwardly of the holding elements. The drive means preferably comprise an air turbine mounted in a rear part of the screwdriver body and coupled to a screwdriver head, the housing and the remainder of the body being telescopically engaged with one another such that pushing the housing rearwardly advances the screwdriver head relatively through the housing to engage a drive recess in a screw held in the holding elements.

Screws are preferably supplied down the feed tube by air pressure.

The feed means for feeding screws one at a time into the feed tube, and subsequently moving them downwardly therein by air pressure, preferably comprises a reciprocable member having a recess of a size to receive a screw therein and reciprocable between a first position in which the recess can receive a screw from screw supply means, for example, a vibratory bowl feeder, and a second position in which the screw can be blown from the recess into the feed tube.

Advantageously the member is a block reciprocable in a feed housing by means of a pneumatic ram and the recess in the member is preferably a groove of generally semicircular cross-section. The feed housing has a portion of its side wall cut-away so that screws, preferably supplied along a track from the vibratory bowl feeder and hanging by their head at an angle of approximately 45° to the vertical, can pass through the cut-away in the wall of the housing and enter the groove one at a time when the slide block is in its first position. When the block is moved into its second position the screws can be blown by air pressure into the feed tube through an aperture in the base of the housing.

The groove must be of a cross-section sufficient to allow the head of the screw to pass there-through as it moves out of the slide block into the feed tube. This could cause difficulty, since the recess is therefore necessarily much larger than the cross-section of the tip of the screw, and it would be possible for the tip of a following screw also to engage in the recess when the slide block is in its first position, the following screw then preventing the slide block from moving to its second position.

To avoid this difficulty, support means are advantageously provided extending into the recess for supporting the tip of the screw, such support means being removed from the recess when the slide block moves into its second position, thereby to support the tip of the screw in a desired position when the block is in the first position but not to obstruct the exit of the head of the screw axially from the recess when the block moves to its second position.

Advantageously, the support means support the tip of the screw such that a side face of the tip of the screw is flush with the adjacent side of the slide block. Preferably the support means are provided on one arm of a bell crank lever which is spring biassed to a position in which the support means extend into the recess and a projection is provided in the feed housing to be engaged by the other arm of the bell crank lever when the slide block moves from its first position, thereby to move the bell crank lever against the spring bias to remove the support means from the recess as the slide block moves from its first position into its second position but to permit the support means to move back into the recess when the slide block returns to its first position.

The invention is diagrammatically illustrated by way of example in the accompanying drawings in which:

FIG. 3 is a perspective view showing the underface, one side face and an end face of a slide block of the feed means;

FIG. 4 is a plan view of the feed means;

Figure 1:
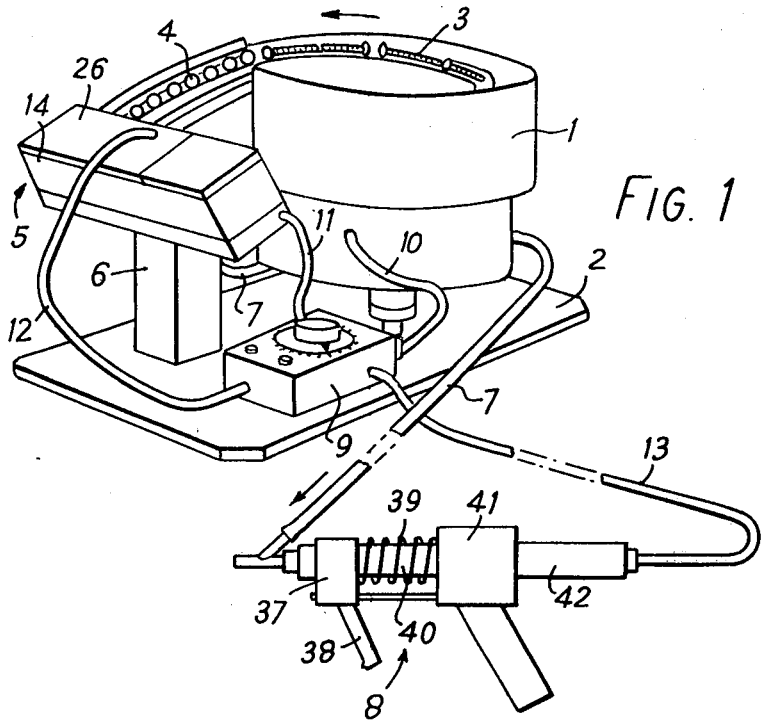
FIG. 1 is an overall view of an automatic screwdriver and feeding apparatus according to the invention including a vibratory bowl feeder.
Figure 2:
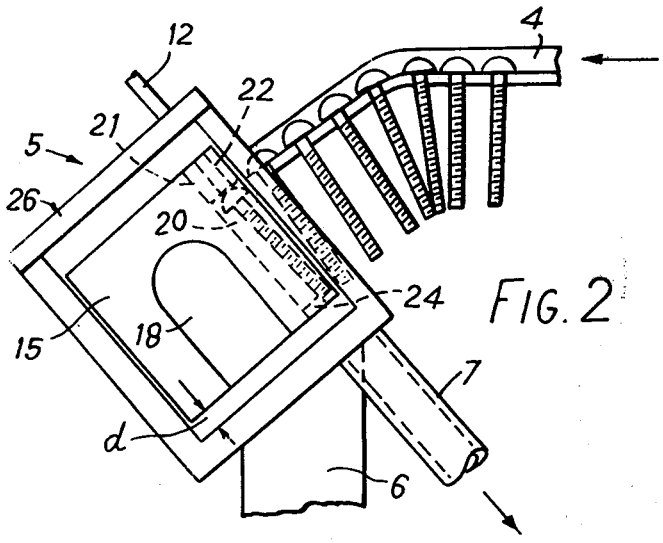
FIG. 2 shows how screws move from a track of the vibratory bowl feeder into feed means to feed screws one at a time into a feed tube.
Figure 5:
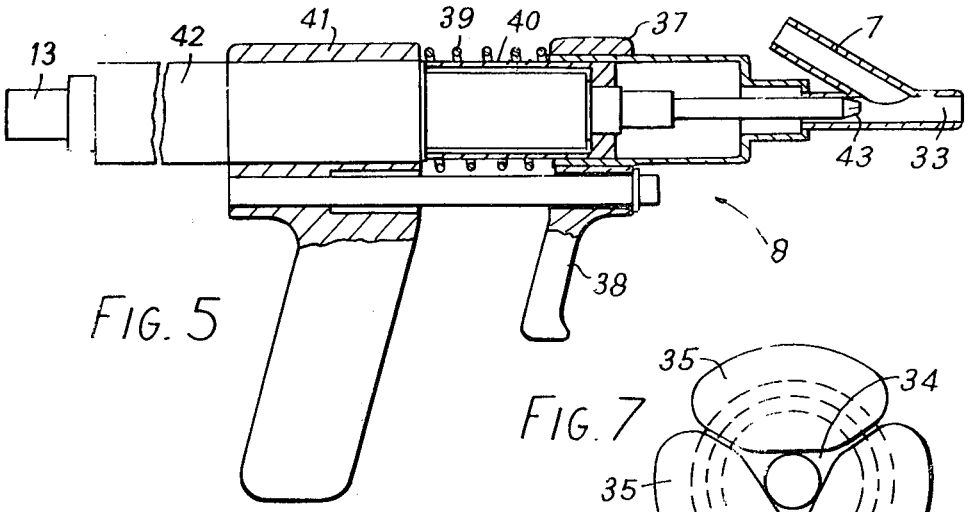
FIG. 5 is a part sectional elevation of a gun portion of the apparatus with screw holding elements removed.

Referring to the drawings, a supply of screws is stored in a vibratory bowl feeder 1 mounted on a base plate 2, screws from within the bowl being fed, by the vibration of the bowl, up a supply track 3 and into a feed track 4 wherein they hang by their heads as shown in FIG. 2. Feed means generally indicated at 5 are supported on a pillar 6 from the base plate 2. From the feed means 5 screws are fed one at a time down a flexible feed tube 7 to a gun portion 8.

A control box 9 on the base plate 2 controls supply of electrical current to the bowl feeder 1 through a cable 10, supply of air through a tube 11 to operate the feed means 5, supply of air through a feed tube 12 to feed screws from the feed means 5 into the feed tube 7 and hence to the gun portion 8 and supply of air through a tube 13 to the gun portion 8 to operate rotary drive means of the gun portion.

The feed means 5 comprises a housing 14 of rectangular shape in which a slide block 15 is mounted for sliding movement (as indicated by the arrow 16 in FIG. 4) under the control of an air ram (not shown but supplied with air through the tube 11) having a circular head 17 which engages in a slot 18 in the slide block 15.

In alignment with the feed track 4 along which the screws are supplied, the wall of the housing 14 is cutaway to form an aperture 19. In the position of the slide block 15 in the housing 14 which is indicated in FIG. 4, a recess 20 in the slide block 15 is aligned with the aperture 19 in the wall of the housing 14 and the leading screw of the screws in the feed track 4, which leading screw hangs from the track at approximately 45° to the vertical, can pass into the recess 20 in the slide block 15 as shown in FIG. 2.

The height at which the slide block 15 is disposed in the housing 14 is adjustable. In FIG. 2 the slide block 14 is shown mounted a distance *d* above the base of the housing 14, the distance *d* being set in accordance with the length of screw which is to be fed. A plug 21 having a bore 22 therethrough is engaged in the upper end of the recess 20 and is selected to be of a length such that its lower face will lie immediately above the head of a screw in the position of the screw in which it is fed into the recess 20 from the feed track 4. A bore 23 extending from the upper face to the lower face of the block 15 is provided adjacent the recess 20.

Into the lower end of the recess 20 projects support means in the form of a support member 24 having a groove 25 therein. The groove 25 is of a depth equal to the diameter of the tip of the screw whereby a screw engaged in the recess 20 will have the outer side of its head and also the outer side of its tip flush with the adjacent side face of the sliding block 15. It is therefore not possible for a portion of the next following screw also to project into the recess 20. The tube 12 from the control box 9 is mounted in a lid 26 of the housing 14 with the tube 12 aligned with the bore 23 in the block 15 when the block 15 is in the position shown in FIG. 4.

If the air ram is then energised to pull the block 15 rightwardly (as viewed in FIG. 4), the bore 22 in the plug 21 will be aligned with the tube 12 and the recess 20 will be aligned with an aperture 27 in the base of the housing 14, which aperture communicates with the feed tube 7.

The support member 24 is provided on the end of one arm 28 of a bell crank lever pivoted on a pin 29 in the underside of the block 15, a spring 30 pressing against the other arm 31 of the bell crank lever to bias the bell crank lever to the position shown in FIG. 3. When the block 15 is pulled rightwardly (as viewed in FIG. 4) by the air ram, the arm 31 of the crank lever abuts a pin 32 secured in the base of the housing 14 and the bell crank lever is pivoted about the pin 29 thereby removing the support member 24 from the recess 20. Air from the pipe 12 can then blow the screw from the recess 20 through the aperture 27 in the base of the housing 14 and into the feed tube 7 to supply the screw to the gun portion 8. Thus the support member 24 supports the tip of the screw in the desired position in the recess 20 when the sliding block 15 is in its leftward position but when the sliding block is moved to its rightward position the support member 24 is moved out of the recess 20 so that it does not impede the exit of the head of the screw from the recess 20 through the aperture 27 and into the feed tube 7.

Figure 7:
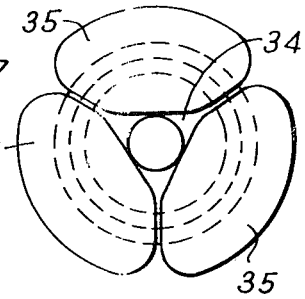
FIG. 7 is a view taken in the direction of arrow VII of FIG. 6.
Figure 6:
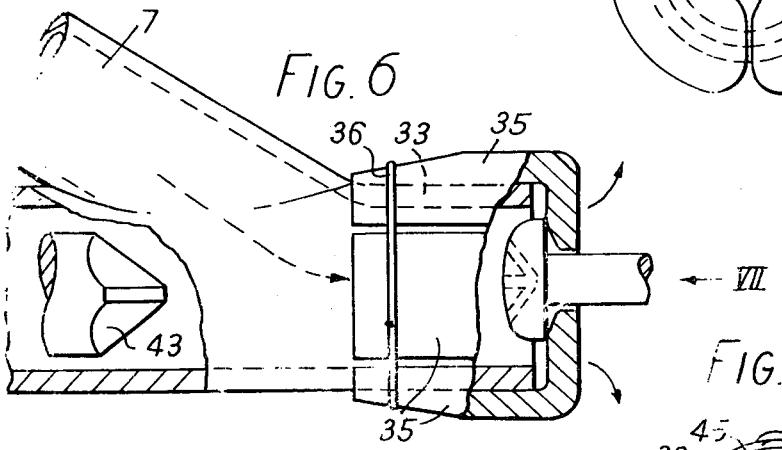
FIG. 6 is a partially sectioned elevation of the front part of the gun portion of the apparatus showing one embodiment of screw holding element.

The screw passes rapidly down the feed tube 7 to the gun portion 8. At the forward end of the gun portion 8 the tube 7 merges into a forward tubular housing 33 of the body of the gun, at an acute angle, so that the screw passes into the forward tubular housing 33. In the embodiment of FIGS. 6 and 7, the tip of the screw passes outwardly through a triangular aperture 34 between three screw holding jaws 35 which are preferably of flexible material and are retained on the tubular housing 33 of the gun 8 by a clamping band 36 which is preferably resilient and must be resilient if the jaws 35 are not formed of flexible material.

The forward tubular housing 33 of the gun portion 8 is mounted on a block 37 which mounts a trigger 38, the block 37 being slidable, against the action of a spring 39, on a tubular projection 40 from a handle portion 41 of the body of the gun portion. The handle portion 41 mounts an air turbine 42 which is supplied with air through the tube 13 and which is connected to a screwdriver head 43 located in the forward tubular housing 33.

When the trigger 38 is pulled back towards the handle portion 41 the screwdriver head 43 advances relatively up the forward tubular housing 33 of the gun portion 8 to engage a drive recess in the head of the screw located in the jaws 35 and the air turbine 42 is automatically energised to drive the screw for rotation into a workpiece. As the screw approaches a fully driven position the head of the screw presses the jaws 35 outwardly, as indicated by arrows adjacent the jaws 35 in FIG. 6, and passes between the jaws 35 the jaws springing back towards one another, due to their own flexibility or the resilience of the band 36, when the screwdriver is retracted from the fully driven screw.

Figure 9:
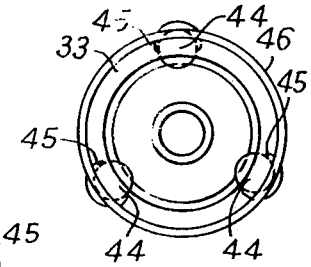
FIG. 9 is a view taken in the direction of arrow IX of FIG. 8.
Figure 8:
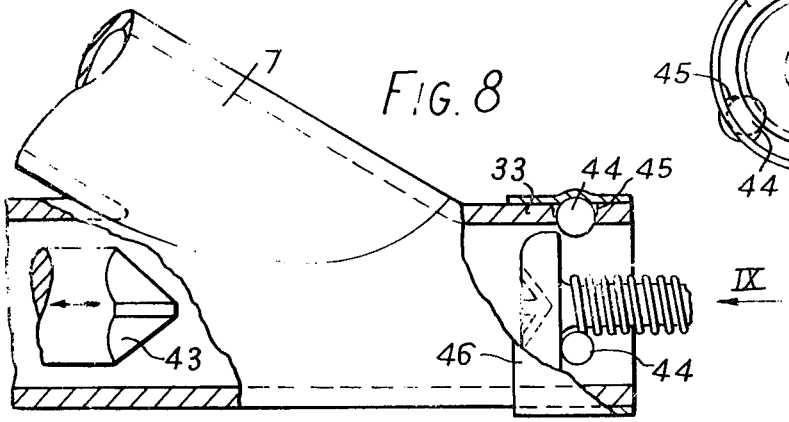
FIG. 8 is a view corresponding to FIG. 6 but showing another embodiment of screw holding element.

In the embodiment of FIGS. 8 and 9, the forward tubular housing 33 of the gun portion 8 has screw holding elements in the form of three steel balls 44, mounted in respective recesses 45 in the wall of the tubular housing 33 and a flexible and resilient rubber sleeve 46 engaged over the tubular housing 33 and the balls 44 to retain the balls 44 in the recesses 45. The sleeve 46 presses the balls 44 radially inwardly of the tubular housing 33 while allowing them to move radially outwardly to permit passage of the screw head therebetween as the screw moves into the fully driven position.

The recesses 45 are undercut and shaped and dimensioned as to prevent the balls 44 from falling into the bore of the tubular housing 33. More or less than three balls may be employed if desired.

The forward tubular housing 33 is advantageously detachable from the remainder of the body of the gun portion 8 to permit ready replacement by another forward tubular housing of different diameter to suit the screws to be driven. A particular tubular housing 33 including balls 44 can however be used for a range of screw head sizes, within limits.

In operation the block 15 is normally in the position in which the recess 20 is aligned with the aperture 27 but by means of a sensing device in the control box 9, sensitive to pressure in the tube 13, is moved leftwardly to align the recess 20 with the aperture 19 in the side wall of the housing 14 when the trigger 38 is pulled towards the handle portion 41 of the gun 8. When the trigger 38 is released at the end of a screwdriving operation, the block 15 moves rightwardly in the housing 14 to move the screw in the recess 20 into alignment with the aperture 27 and allow the air from the tube 12 to blow the screw through the feed tube 7 to the jaws 35 ready for a further operation.

It will be seen that with the automatic screwdriving and feeding apparatus of the invention an operator can, using only one hand, rapidly and easily drive screws into workpieces. This is of considerable advantage in production assembly lines since it permits the operator to use the other hand for aligning and holding two articles to be secured together.

If desired the tubular housing 33 can be of more extended form than shown, to allow screws to be driven into the base portion of deep recesses.

I claim:

1. An automatic screw-driving and feeding apparatus comprising:

(i) a screwdriver body including a tubular housing axially movable with respect to the remainder of the body;

(ii) a plurality of screw holding elements mounted in said tubular housing;

(iii) means for resiliently biasing said screw holding elements inwardly such that they may hold a screw in axially disengageable manner;

(iv) drive means in the screwdriver body adapted, upon axial inwards movement of the tubular housing, the engage with the screw and apply rotary drive thereto;

(v) a feed tube merging with the housing at an acute angle rearwardly of the holding elements;

(vi) feed means which supply screws one at a time to said feed tube, said feed means including:

(a) a feed housing, and a block reciprocable therein, the block having a recess of a size to receive a screw therein and reciprocable between a first position in which the recess can receive a screw from screw supply means, and a second position in which the screw can pass from the recess into the feed tube, and the feed housing having a portion of its side wall cut away so that screws supplied along a track and hanging by their heads therefrom can pass through the cut away in the wall of the housing and enter said recess one at a time when the slide block is in said first position;

(b) support means extending into said recess, such support means being removed from the recess when the slide block moves into its second position, the support means supporting the tip of the screw in a desired position when the block is in its first position but not obstructing exit of the head of the screw axially from the recess when the block moves to its second position.

2. An automatic screw-driving and feeding apparatus comprising:

(i) a screwdriver body including a tubular housing axially movable with respect to the remainder of the body;

(ii) a plurality of resiliently deformable screw holding elements mounted in said tubular housing and adapted to hold a screw in axially disengageable manner;

(iii) drive means in the screwdriver body adapted, upon axial inwards movement of the tubular housing, to engage with the screw and apply rotary drive thereto;

(iv) a feed tube merging with the housing at an acute angle rearwardly of the holding elements;

(v) feed means which supply screws one at a time to said feed tube, said feed means including:

(a) a feed housing, and a block reciprocable therein, the block having a recess of a size to receive a screw therein and reciprocable between a first position in which the recess can receive a screw from screw supply means, and a second position in which the screw can pass from the recess into the feed tube, and the feed housing having a portion of its side wall cut away so that screws supplied along a track and hanging by their heads therefrom can pass through the cut away in the wall of the housing and enter said recess one at a time when the slide block is in said first position;

(b) support means extending into said recess, such support means being removed from the recess when the slide block moves into its second position, the support means supporting the tip of the screw in a desired position when the block is in its first position but not obstructing exit of the head of the screw axially from the recess when the block moves to its second position.

3. An automatic screw-driving and feeding apparatus, as claimed in claim 1, in which the support means support the tip of the screw such that a side face of the tip of the screw is flush with the adjacent side of the slide block.

4. An automatic screw-driving and feeding apparatus, as claimed in claim 2, in which the support means support the tip of the screw such that a side face of the tip of the screw is flush with the adjacent side of the slide block.

5. An automatic screwdriving and feeding apparatus, according to claim 1 in which the support means are provided on one arm of a bell crank lever which is spring biased to a position in which the support means extend into the recess, the feed housing including a projection to be engaged by the other arm of the bell crank lever when the slide block moves from its first position, thereby to move the bell crank lever against the spring bias to remove the support means from the recess as the slide block moves from its first position into its second position but to permit the support means to move back into the recess when the slide block returns to its first position.

6. An automatic screwdriving and feeding apparatus, according to claim 2 in which the support means are provided on one arm of a bell crank lever which is spring biased to a position in which the support means extend into the recess, the feed housing including a projection to be engaged by the other arm of the bell crank lever when the slide block moves from its first position, thereby to move the bell crank lever against the spring bias to remove the support means from the recess as the slide block moves from its first position into its second position but to permit the support means to move back into the recess when the slide block returns to its first position.

* * * * *